United States Patent [19]

Glasser

[11] Patent Number: 4,878,421

[45] Date of Patent: Nov. 7, 1989

[54] RADON VENTING SYSTEM FOR EXISTING STRUCTURES

[75] Inventor: Joseph Glasser, Storrs, Conn.

[73] Assignee: Eljen Corporation, Storrs, Conn.

[21] Appl. No.: 202,703

[22] Filed: Jun. 3, 1988

[51] Int. Cl.[4] ..... F24F 7/013

[52] U.S. Cl. ..... 98/42.07; 98/31; 98/42.02

[58] Field of Search ..... 52/169.5, 302, 303, 52/173 R, 742; 98/31, 42.02, 42.04, 42.06, 42.07, 115.1

[56] References Cited

U.S. PATENT DOCUMENTS

| | | | |
|---|---|---|---|
| 3,332,185 | 7/1967 | Adams | 52/169.5 X |
| 4,620,398 | 11/1986 | Wallin | 52/169.1 |
| 4,733,989 | 3/1988 | Harriett | 52/164.5 X |
| 4,760,674 | 8/1988 | Brand et al. | 52/169.5 |

OTHER PUBLICATIONS

"Radan Reduction Techniques for Detached Houses", *Technical Guidance,* EPA/625/5-86/019, U.S. Environmental Protection Agency, Jun. 1986, Copy in 96-42.02.

*Primary Examiner*—Harold Joyce

*Attorney, Agent, or Firm*—McCormick, Paulding & Huber

[57] ABSTRACT

A basement below a dwelling structure has the walls covered by a rigid polystyrene panel that has raised lands to define a space on both sides to collect radon gas. An impermeable polyethlene sheet is sealed top and bottom to isolate the joint between the basement floor and the walls so radon gas is trapped in these spaces. A fan in a basement window is used to provide positive displacement of any radon gas trapped by this system.

1 Claim, 1 Drawing Sheet

RADON VENTING SYSTEM FOR EXISTING STRUCTURES

Figure 1:
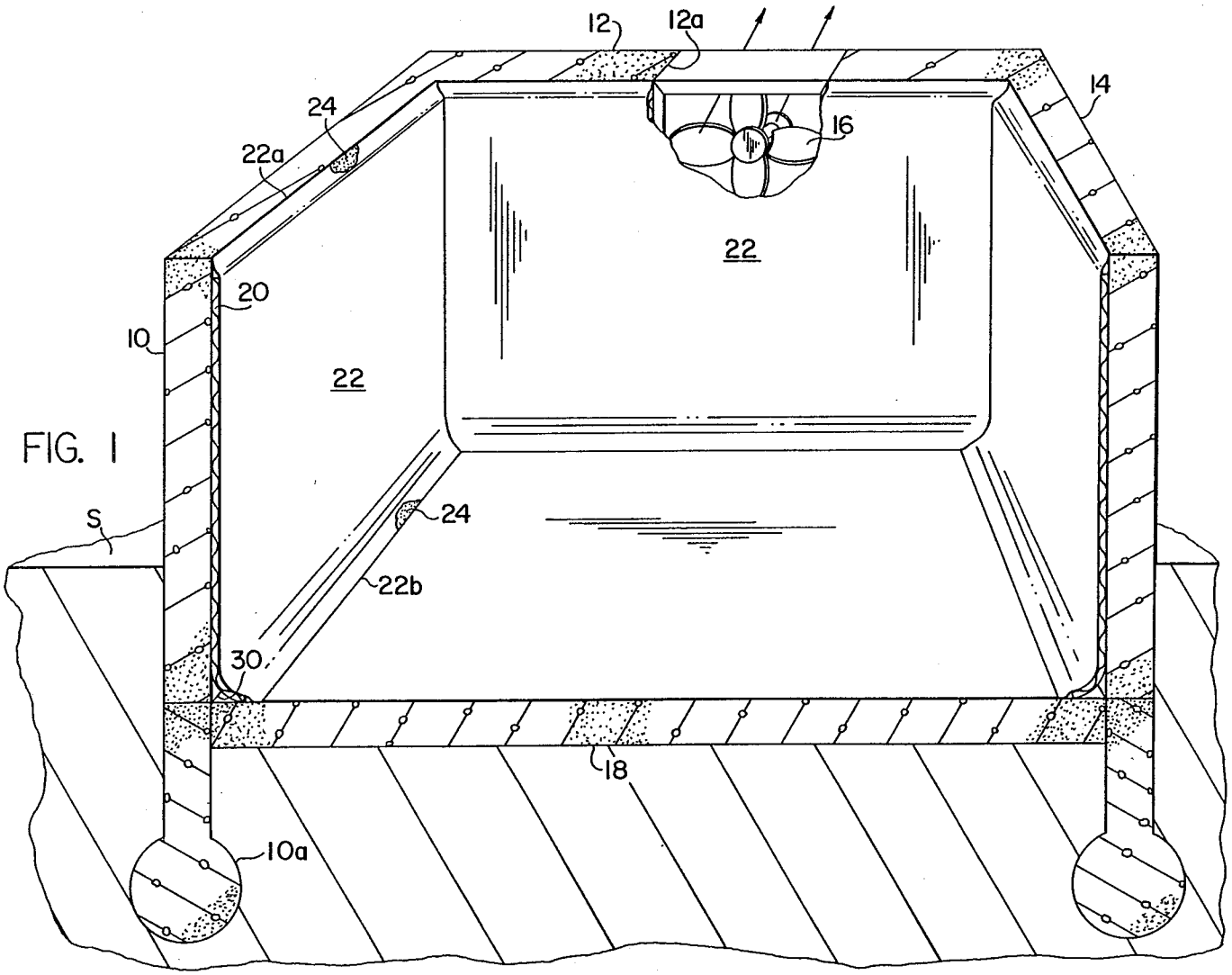

This invention relates generally to a method for venting radon gas from the basement structure of a dwelling, and deals more particularly with an improved radon venting system that is adapted for use in retrofitting an existing home to eliminate the entrapment of radon gas in the relatively confined space beneath the home defined by the concrete basement floor and structure supporting walls of the dwelling.

FIG. 1 illustrates, in perspective and in cross section, a dwelling structure that has been modified in accordance with the method of the present invention.

Turning now to the drawing in greater detail, FIG. 1 illustrates a typical basement structure wherein supporting walls 10, 12 and 14 are poured on footings (one of which is shown generally at 10a in FIG. 1) that extend well below the surface S of the surrounding earth so as to provide a basement space beneath the actual dwelling (not shown) that is built on the supporting walls 10, 12 and 14 in accordance with conventional practice.

Actually, at least four such walls 10, 12 and 14 would be provided but one wall has been omitted in the vertical cross section/perspective view illustrated in FIG. 1. The structure also includes a poured concrete floor 18 that is generally provided somewhat below the level of the surrounding earth S, and although this floor 18 might be provided with a polyethylene sheet in present homes to protect the occupants of the structure against the buildup of radon gas in the dwelling structure itself, past practice has resulted in such floors 18 being poured directly on a packed earth or crushed stone surface as suggested in FIG. 1.

One of the walls 12 may include a window opening 12a but as long as an opening can be provided for receiving an exhaust fan such as that indicated generally at 16 the advantages of the present invention may in fact be realized.

Turning now to the method of the present invention, each of the walls 10, 12 and 14 is provided with a plastic panel 10 that is arranged alongside the wall such that one face of the panel engages the wall structure 10 and the other face of the panel faces inwardly toward the interior of the basement. Each plastic panel 20 includes a pattern of raised lands and depressions so that on one face a raised land is provided where on the opposite face a depression is provided. Such a plastic panel is available from several sources including Eljen Corporation, 15 Westwood Road, Storrs, Connecticut 06268. These plastic panels are commonly referred to as cores or armatures and when surrounded by permeable plastic sheet are commonly used adjacent the exterior of a concrete wall structure to facilitate drainage along the wall structure. In such applications a drainage pipe may be provided along the marginal lower edge of such panels to carry away ground water and thereby avoid leakage of ground water into a structure such as that depicted in FIG. 1. See for example the disclosure in prior art U.S. Pat. No. 4,490,072.

The preferred form of panel for the present invention has valleys and raised lands that are spaced from one another in the plastic panel material by a distance of approximately 3/4 inch, and the sheet is preferably formed from a relatively rigid plastic material or relatively stiff plastic material such as polystyrene. The plastic panel is preferably on the order of 3/4 inch in overall thickness between the lands or raised areas on one face to the raised lands on the opposite face, and has a thickness on the order of 1/32 inch (or approximately 15–45 mils).

The lower marginal edges of the plastic panel may rest on the upper surface of the concrete floor 18, or may be bent slightly to better overlap the joint between the concrete floor and the wall 10 as shown in FIG. 1. In any event, the present invention also calls for providing an impermeable polyethylene sheet 22 over the exposed face of the panel 20 for sealing the upper marginal edge of the sheet 22 as indicated generally at *22a*. The lower marginal edge of the sheet *22b* is also sealed to the floor 18 as also shown in FIG. 1. Adhesive material may be provided as indicated generally at 24 along these upper and lower marginal edges *22a*, *22b* of the sheet for this purpose. Where the sheet 22 is of insufficient lateral extent more than one piece of polyethylene sheet material may be required, and the sheets should be overlapped and sealed so as to prevent the escape of gas from the space provided between the concrete wall and inner face of the plastic panel 20 and the outer face of the panel and the back of the sheet 22.

Each of the walls 10, 12 and 14 is in turn covered by sheets 20, 20 that are sealed to the floor and to the top of the wall as mentioned previously, and to the lateral edges of one another as required. This provides an enclosed space for any radon gas passing upwardly through the joint 30 between the concrete floor 18 and the wall structure, or through cracks in the wall structure iteself. In further accordance with the present invention an exhaust fan is provided in an opening of the wall structure as suggested generally at 16 and operated intermittently to ventilate this space and hence to evacuate the buildup of radon gas entering the enclosed space referred to above and thereby avoiding the presence of excess radon gas in the enclosed basement structure itself.

I claim:

1. A method for venting radon gas from the basement of a structure that includes a concrete basement floor and structure supporting walls that rest on footings outside the concrete floor, said method comprising the steps of:

providing panels of rigid plastic material alongside the walls, each panel having opposed faces, and each face having a pattern of raised lands and of depressions on one face that define depressions and raised lands respectively on the opposite panel face, covering the panels with an impermeable plastic sheet or sheets and overlapping and sealing the sheets to cover the entire basement supporting walls of the structure, sealing the upper marginal edge of the sheets to the top of the supporting walls, laying the lower marginal edge of the sheet on the concrete floor so as to cover the joint between the floor and the wall structure, providing an exhaust fan in a basement window opening of the structure, said sheets also covering said basement window opening, operating the fan at least intermittently to ventilate the spaces on both sides of the plastic panels and hence to evacuate any buildup of radon gas in the basement due to seepage through cracks in the supporting walls or do to seepage through the joint between the floor and these walls.

* * * * *